US006076279A

United States Patent [19]

Saalasti

[11] Patent Number: 6,076,279

[45] Date of Patent: Jun. 20, 2000

[54] METHOD AND A DEVICE FOR IMPROVING LIQUID REMOVAL

[75] Inventor: Timo Saalasti, Espoo, Finland

[73] Assignee: Finbark Oy, Espoo, Finland

[21] Appl. No.: 09/005,231

[22] Filed: Jan. 9, 1998

[51] Int. Cl.[7] ..... F26B 5/14

[52] U.S. Cl. ..... 34/397; 34/398; 34/399

[58] Field of Search ..... 34/331, 344, 350, 34/358, 382, 397, 398, 399, 419, 111, 117, 120, 123, 143, 144; 100/37, 38, 302; 162/206, 207, 358.5

[56] References Cited

U.S. PATENT DOCUMENTS

| | | | |
|---|---|---|---|
| 2,209,761 | 7/1940 | Berry | 34/399 X |
| 3,286,360 | 11/1966 | Walker | 34/399 |
| 3,633,282 | 1/1972 | Candor et al. | 34/250 |
| 4,949,471 | 8/1990 | Garcia Pastor et al. | 34/399 |
| 5,669,159 | 9/1997 | Orloff et al. | 34/398 |

FOREIGN PATENT DOCUMENTS

| | | |
|---|---|---|
| 69207 | 8/1985 | Finland . |
| 90442 | 10/1993 | Finland . |
| 934893 | 5/1994 | Finland . |
| 2748685 | 11/1997 | France . |
| 1005836 | 3/1983 | U.S.S.R. . |
| WO 9410373 | 5/1994 | WIPO . |

*Primary Examiner*—Stephen Gravini
*Attorney, Agent, or Firm*—Birch, Stewart, Kolasch & Birch, LLP

[57] ABSTRACT

A method and press for heating a material to be pressed. The method includes prepressing the material without heat, or with a generally minimal amount of heat applied. Then heating the material heavily at a wettest part of the material, and simultaneously pressing the material during the heating of the material.

14 Claims, 1 Drawing Sheet

METHOD AND A DEVICE FOR IMPROVING LIQUID REMOVAL

BACKGROUND OF THE INVENTION

1. Field of the Invention

The present invention relates generally to a method and device for removing a liquid disposed in a material.

2. Description of the Related Art

Mechanical pressing is commonly used for drying various water-containing materials, for example bark and sludge.

The drum press comprises a rotating drum containing an internal parallel eccentric press roll. When the drum rotates, the material to be processed is pressed between the press roll and the drum. Usually the drum is perforated, and the liquid leaves the pressed material through the drum.

Using the drum press, quite high dry substance concentrations can be reached. For bark, depending on the type of wood, the concentration is preferably 40–45%, and optimally 45–50%. For sludge, the concentration is typically somewhat lower, depending on the type of sludge and above all on the biological sludge content.

If still higher dry substance concentrations are desired, the temperatures of the material to be pressed can be increased. As known, the material can be heated, for example, by feeding steam into the material before or during pressing. The latter is done typically in a screw press, where feeding steam into the material through holes in the screw shaft is easy. Examples of the higher final dry substance concentration achieved by heating can be found, for instance, in patent application FI 934893 and SU inventor's certificate 1005836, where pulp suspension is heated before filtering. Heating of the material increases the final dry substance concentration, for example, because warm water has lower viscosity and so exhibits a lower flow resistance when it leaves the material. However, it is not often that pulp suspensions shall be heated, as they typically are not already very hot after the digesting process.

However, the heating processes of the prior art are not optimal since the gain collected by them has remained quite small compared with the required energy consumption, so heating the water contained in the material to be dried demands large amounts of energy. Thus one should observe, with respect to the above-mentioned reference publications, that the entire flow of the material that is to be dried is heated.

SUMMARY OF THE INVENTION

The objective of the invention is to provide a method and a device, in its most preferable design a drum press, which, for example, can be used for pressing solid materials and materials containing liquids, when the aim is to press liquid from the material.

The object of the invention here being presented is to give to the above mentioned problem a very simple and elegant solution, with which one in practice has proved that one gets considerable dewatering advantages meanwhile the energy consumption is significantly reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
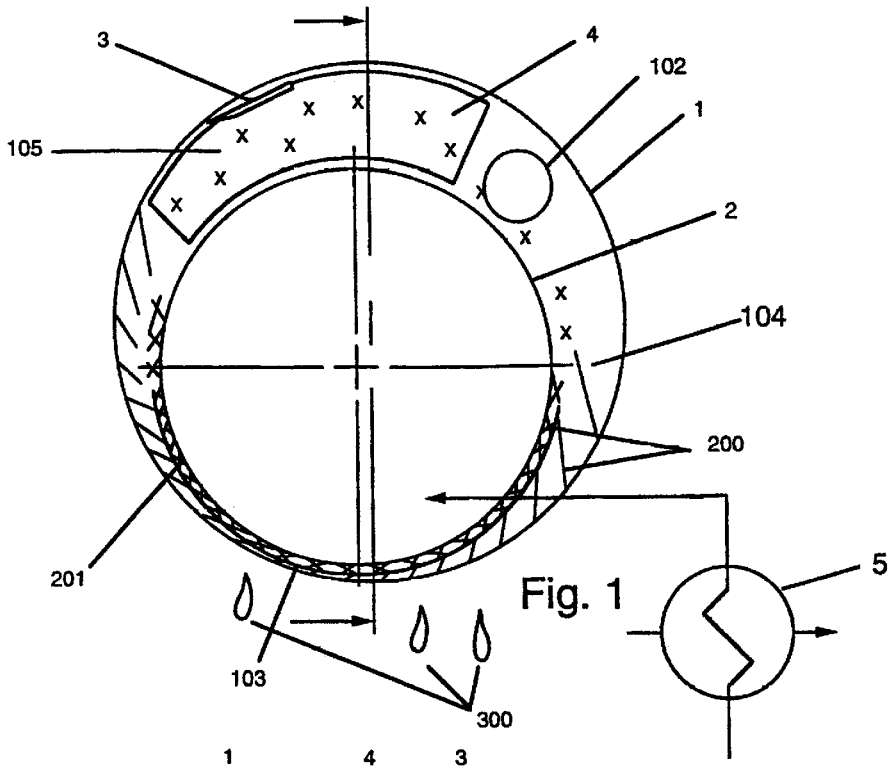
FIG. 1 shows a front view of the drum press.
Figure 2:
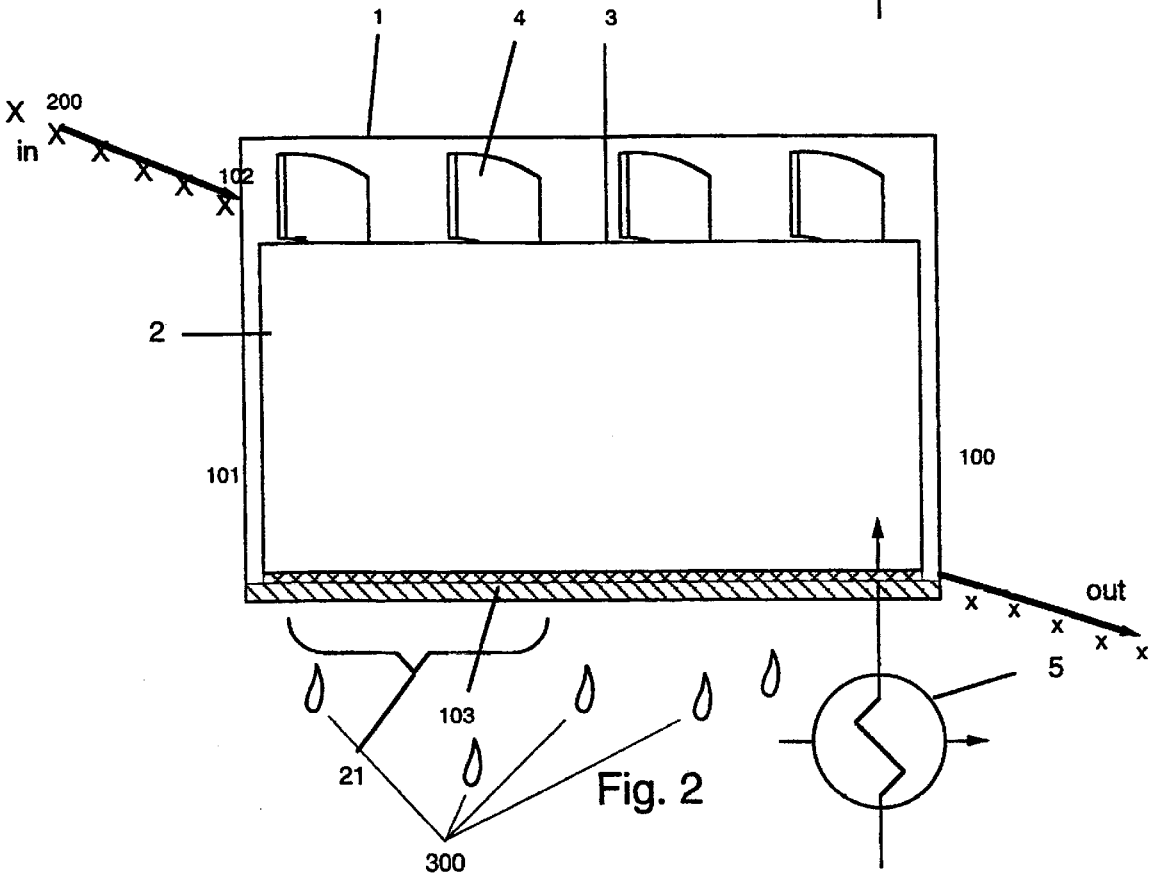
FIG. 2 shows a side view of the drum press.

The press according to the present invention can be, for example, a drum, roll, double-roll, screw, chain-mat or fabric press.

The press used in the method according to the invention comprises a heating device, with which the material is heated without having to heat all the water tied in the material. Thus one can significantly reduce energy consumption and yet heat the material and the removing water so as to make the separation of liquid more efficient, and the material drier.

The method is characterized in that:

1) the material is prepressed only little or not at all during heating;
2) then the material is heated more intensively;
3) then the material is pressed and heated intensively several times over, so that each heating cycle is followed by a pressing cycle; and
4) step 3) is preferably carried out so that heat is always conducted through the wettest part of the material, in order to more efficiently remove remaining water.

As the heating is always applied to the residual water in the driest possible material, the total energy consumption is minimized. In a preferred application of the method, the heat is led counterstream against the flow relative to the material's drying so that the most efficient (hottest) heating is directed towards the driest material.

The device according to the invention has a heating press roll that heats the material. The press is preferably designed as a drum press. The press can also have a heating drum or a device for heating directly the material with steam, but nonetheless so that the pressing and heating is done in a way corresponding to the above described method.

The method can above all be used for drying sludge, for example from a purification plant, or bark. The method can naturally also be used for drying any other material, for example pulp, as discussed in the above mentioned SU inventor's certificate and in the publication FI 90442.

Below is described, with closer reference to the appended drawings, a preferred embodiment in form of a device that utilizes the method according to the invention.

The design applied to drum presses has also been discussed, for example in publications FI 69207 and WO 94/10373. Below is described only shortly the principles of the actual drum press of the present invention, and those parts that are relevant for the invention.

The main parts of the press comprise a rotating drum 1, a press roll 2 placed eccentrically in the drum 1, and a doctor blade type scraper 3 that loosens the material 200 from surface of the drum. The drum has holes through which the liquid 300 leaves the pressed material. The distance between the press roll and the drum is preferably made adjustable.

The drum press can be such that either the press rolls the drum or both the press roll and the drum are driven.

Scraper 3 is a blade placed stationary along the drum after the pressing point. The scraper 3 is fastened at both ends in the press body. Attached to the scraper 3 are guide plates 4 which guide the material 200. To guide the material 200 out from the drum 1, the press roll 2 and the drum 1 are placed at an angle, or the guide plates 4 are placed in an angle towards the outfeed end. The length and slope of the drum 1, and the number of plates and their angles determine how many times the material 200 is pressed when passing through the drum 1 on a spiral orbit around the press roll 2.

The press roll 2 is equipped with a heating device 5. It is preferably used for conducting hot steam through the press roll 2. Steam is preferably brought to the system from the direction of outfeed end 100 towards the infeed end 101. Thus heating occurs against the flow. If the press roll 2 is used as a pressure vessel, most preferably as decribed herein below, the press roll 2 is also equipped with devices for collecting the condensate, otherwise the steam is allowed to exit through holes in the press roll 2 or through a special steam feeding nozzle. If the press roll 2 has holes, the water can be led away through these in the opposite direction. Below, the press roll is assumed to be a pressure vessel.

The material 200 that shall be pressed is fed at point 102 into the drum 1. When entering the nip and while being subject to a rising pressure, the material 200 is dewatered relatively quickly to a specific dry substance concentration, which is possible in regard to the pressing power and other pressing properties and in regard to the material 200 properties, especially the temperature. When the material 200 is cold, it does not become completely dry, but most of the water is cold when separated. The harder the material 200 is pressed against the press roll 2, the more efficiently the heat is brought into it. No pressure is directed against the upper surface of the press roll 2. Therefore, heat transfer is most efficient only at press nip 103. Hence the water remaining in the material 200 at point 104 does not get notably warmer before exiting.

Now the press roll 2 heats the material 200 at the nip. The wettest part 201 of the material 200 dried in the nip lies against the drum 1 and is now most efficiently heated. When the material 200 exits the nip and is communicated to the following pressing at point 105, it is not under pressure and one can, if necessary, mix it or treat it in another way. In any case, one has along with the rising temperature decreased the viscosity of the water remaining in the material 200, and the water will then move easier through the material 200 and drum 1. Also the bindings (particularly hydrogen bindings between water and fibres) that exist between the water and solid substance of the material 200 weaken with rising temperature, which even more efficiently helps remove the water from the material 200.

When the material 200 is carried to another similar pressing cycle, again a significant amount of the removable water is removed without becoming any warmer, while on the other hand the water remaining after the pressing is again heated still more, and thus removed more efficiently during the next pressing.

The fact that the method is applied so that the press roll is a pressure vessel, also means that as much steam condenses as the sludge can absorb energy when it gradually dries. Thus, feeding of superfluous energy is not possible, not even if the rate of the flow of the material 200 would vary.

One can control the method properties by isolating part 21 at the feeding end of press roll 2 completely from the steam feeding. Then this part is not heated at all. Another possibility is after prepressing to feed in some steam directly into the material. Then only a little steam has to be fed in, because most of the water has already been removed. The process then continues after the direct steam treatment as described above.

When the separation of water becomes more efficient, using less pressing power and equipment, the desired dry substance concentration can be achieving. Using the above described multi-phase press the resulting advantages are numerous.

The above embodiment used steam for heating. However, heating with a hot liquid, the use of electricity or in any suitable manner is possible.

The method can within the scope of the patent claims also be applied to other types of presses. However, the drum press is a preferable application because:

a) in the drum press, the material is pressed as a thin mat and in a long nip, which makes it easier to heat the material (for example, a screw press has a thick mat, and a double-roll press has a short nip)

b) in the drum press, the material is inherently brought to the first pressing without heating c) in the drum press, a preferable pressure variation cycle for the method is inherently achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for drying material in a press comprising the steps of:

prepressing said material without heat, or with a generally minimal amount of heat applied;

heating said material heavily at a wettest part of said material; simultaneously pressing and heating said material at the same point on said material; and repeating the steps of heating and pressing at least once.

2. The method according to claim 1, further comprising the step of feeding said material onto a press roll being eccentrically placed in a rotating drum.

3. The method according to claim 1, further comprising the step of decreasing a pressure against said material after the step of heating and before a subsequent step of prepressing.

4. The method according to claim 1, wherein the heat energy introduced in the step of heating is applied to said material after being dried by steps failing to use heat.

5. The method according to claim 1, further comprising the step of mixing said material while failing to be under pressure, whereby said material is relieved of a liquid portion contained therein.

6. The method according to claim 1, further comprising the step of outfeeding said material after a predetermined number of drying steps has occurred.

7. The method according to claim 1, wherein the steps of heating and pressing includes the step of expelling a liquid from said material.

8. The method according to claim 1, further comprising the step of isolating at least a portion of said material from a source of heating.

9. The method according to claim 1, wherein the steps of prepressing, heating and pressing include prepressing, heating and pressing material which is bark, sludge or pulp.

10. The method according to claim 1, wherein the step of heating further includes heating said material with a heated press roll.

11. The method according to claim 1, wherein the step of heating further includes heating said material with a drum, double-roll, screw, chain-mat or fabric press.

12. The method according to claim 1, wherein the step of heating heats said material with steam.

13. The method according to claim 1, wherein the step of pressing expunges a liquid portion contained in said material through holes in a press drum.

14. The method according to claim 1, wherein the step of heating supplies heat to said material against a flow of said material.

* * * * *